US007485013B2

(12) United States Patent
Kuo

(10) Patent No.: US 7,485,013 B2
(45) Date of Patent: Feb. 3, 2009

(54) ELECTRICAL CONNECTOR ASSEMBLY HAVING IMPROVED COVER

(75) Inventor: Peter Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/975,927

(22) Filed: Oct. 23, 2007

(65) Prior Publication Data

US 2008/0096437 A1 Apr. 24, 2008

(30) Foreign Application Priority Data

Oct. 23, 2006 (CN) ..... 2006 2 0127064

(51) Int. Cl.
*H01R 13/514* (2006.01)

(52) U.S. Cl. ..... 439/731

(58) Field of Classification Search ..... 439/610, 439/609, 701, 731, 353, 357, 358
See application file for complete search history.

(56) References Cited

U.S. PATENT DOCUMENTS 5,383,794 A * 1/1995 Davis et al. ..... 439/352
5,545,052 A * 8/1996 Hirai ..... 439/354
5,569,047 A * 10/1996 Pauza et al. ..... 439/353
5,797,771 A * 8/1998 Garside ..... 439/610
5,820,412 A * 10/1998 Koegel et al. ..... 439/610
5,831,815 A * 11/1998 Miller et al. ..... 361/679
6,146,210 A * 11/2000 Cha et al. ..... 439/680
6,165,017 A * 12/2000 Kuo ..... 439/610
6,171,136 B1 1/2001 Liu et al.
6,290,530 B1 * 9/2001 Chang ..... 439/379
6,328,588 B1 * 12/2001 Tsai et al. ..... 439/352
6,358,090 B1 * 3/2002 Kuan ..... 439/607
6,413,112 B2 * 7/2002 Semmeling et al. ..... 439/358
6,582,255 B2 * 6/2003 Peterson et al. ..... 439/701
6,599,151 B2 * 7/2003 Chiran et al. ..... 439/610
6,607,397 B1 * 8/2003 Zhang et al. ..... 439/357
6,866,539 B2 * 3/2005 Chang ..... 439/460
6,926,553 B2 * 8/2005 Wu ..... 439/497
6,932,640 B1 * 8/2005 Sung ..... 439/405
6,951,474 B1 10/2005 Wu
6,966,797 B2 * 11/2005 Ko ..... 439/610
6,976,865 B2 12/2005 Wu
6,984,151 B2 * 1/2006 Wu ..... 439/610
6,988,908 B2 * 1/2006 Zhang et al. ..... 439/358
7,021,959 B2 * 4/2006 Tsuji et al. ..... 439/470
7,056,152 B2 * 6/2006 Huang et al. ..... 439/607
7,083,472 B2 * 8/2006 Gordon et al. ..... 439/610
7,198,522 B1 * 4/2007 Ho et al. ..... 439/660
7,249,974 B2 * 7/2007 Gordon et al. ..... 439/610
7,258,565 B2 * 8/2007 Huang et al. ..... 439/353
7,311,545 B2 * 12/2007 Wu ..... 439/358
7,341,472 B2 * 3/2008 Chao et al. ..... 439/358
7,396,250 B1 * 7/2008 Huang ..... 439/352

(Continued)

*Primary Examiner*—Ross N Gushi
(74) *Attorney, Agent, or Firm*—Wei Te Chung

(57) ABSTRACT

An electrical connector assembly includes a cover, a connector housing received in the cover and including a mating port, and a connecting port, and an insulative cap, including a generally rectangular base section with a central opening for allowing said mating port to extend through, and a pair of locking barbs rearwardly from the base section. The cover includes a pair of ribs formed at inner thereof, and a pair of retaining slots between the ribs and corresponding lateral walls thereof, each retaining slot defining a hollow at a root region thereof, tips of the locking barbs are respectively retained within said hollows of retaining slots for holding the insulative cap and the cover together.

17 Claims, 6 Drawing Sheets

U.S. PATENT DOCUMENTS

| | | | | |
|---|---|---|---|---|
| 7,416,432 | B2 * | 8/2008 | Shi et al. | 439/362 |
| 2001/0055909 | A1 * | 12/2001 | Van Zanten | 439/610 |
| 2002/0025722 | A1 * | 2/2002 | Inagawa et al. | 439/610 |
| 2002/0086583 | A1 * | 7/2002 | Casey | 439/610 |
| 2004/0077228 | A1 * | 4/2004 | Wu | 439/701 |
| 2004/0137779 | A1 * | 7/2004 | Wei | 439/358 |
| 2004/0166742 | A1 * | 8/2004 | Chiu et al. | 439/701 |
| 2004/0266273 | A1 * | 12/2004 | Wu | 439/701 |
| 2005/0048830 | A1 * | 3/2005 | Li et al. | 439/358 |
| 2005/0064758 | A1 * | 3/2005 | Li et al. | 439/358 |
| 2006/0205277 | A1 * | 9/2006 | Gordon et al. | 439/610 |
| 2008/0032554 | A1 * | 2/2008 | Kuo et al. | 439/607 |

* cited by examiner

ELECTRICAL CONNECTOR ASSEMBLY HAVING IMPROVED COVER

CROSS-REFERENCE TO RELATED APPLICATION

This application is related to U.S. patent application Ser. No. 11/646,838 filed on Dec. 27, 2006, invented by a same inventor, Peter Kuo, entitled "ELECTRICAL CONNECTOR ASSEMBLY HAVING IMPROVED LOCKING MEMBER", which is assigned to a same assignee as this application.

BACKGROUND OF THE INVENTION

1. Field of the Invention

The present invention relates generally to an electrical connector assembly, and more particularly to an electrical connector assembly for transmitting signals in an interconnection system.

2. Description of Related Arts

With the development of communication and computer technology, many electrical connectors with conductive elements are desired to construct a large number of signal transmitting paths between two electrical devices. Such electrical connectors are widely used in connecting systems of electrical devices and the like devices requiring data processing and communication.

For example, U.S. Pat. No. 6,171,136B1 which issued to Northstar Farest on Jan. 9, 2001 shows a male type USB (Universal Serial Bus) connector comprising a connector body, a cable connected to the connector body, two symmetrical insulating shells fastened together and covered on the lateral side walls and rear side wall of the connector body and a part of the cable to secure the cable to the connector body, an insulating cap fastened to front portions of the connector body and the insulating shells, and two packing strips mounted between the backward coupling flange of the cap and the top, bottom side walls of the connector body.

However, said electrical connector in use needs to plug into or unplug from the complementary connector frequently, thereby causing two packing strips easy to escape from said electrical connector. In addition, in a vibrative circumstance, two packing strips are easy to loose and cannot inferentially mount said insulating cap with the connector body. Thus, a reliable connection between said electrical connector and the complementary connector is affected.

Hence, an electrical connector assembly having improved cover is desired.

SUMMARY OF THE INVENTION

Accordingly, an object of the present invention is to provide an electrical connector assembly having improved cover, thereby, assuring a reliable connection.

To achieve the above objects, an electrical connector assembly comprises a cover including a pair of ribs formed at inner thereof, and a pair of retaining slots between the ribs and corresponding lateral walls thereof, each retaining slot defining a hollow at a root region thereof, a connector housing received in the cover, and including a mating port, and a connecting port, a plurality of contacts, each contact including a mating end received in the mating port, and a tail end rearwardly extending beyond the connecting port, a cable, electrically terminated to said tail ends of the contacts, and an insulative cap, including a generally rectangular base section with a central opening for allowing said mating port to extend through, and a pair of locking barbs rearwardly from the base section; wherein tips of the locking barbs are respectively retained within said hollows of retaining slots for holding the insulative cap and the cover together.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
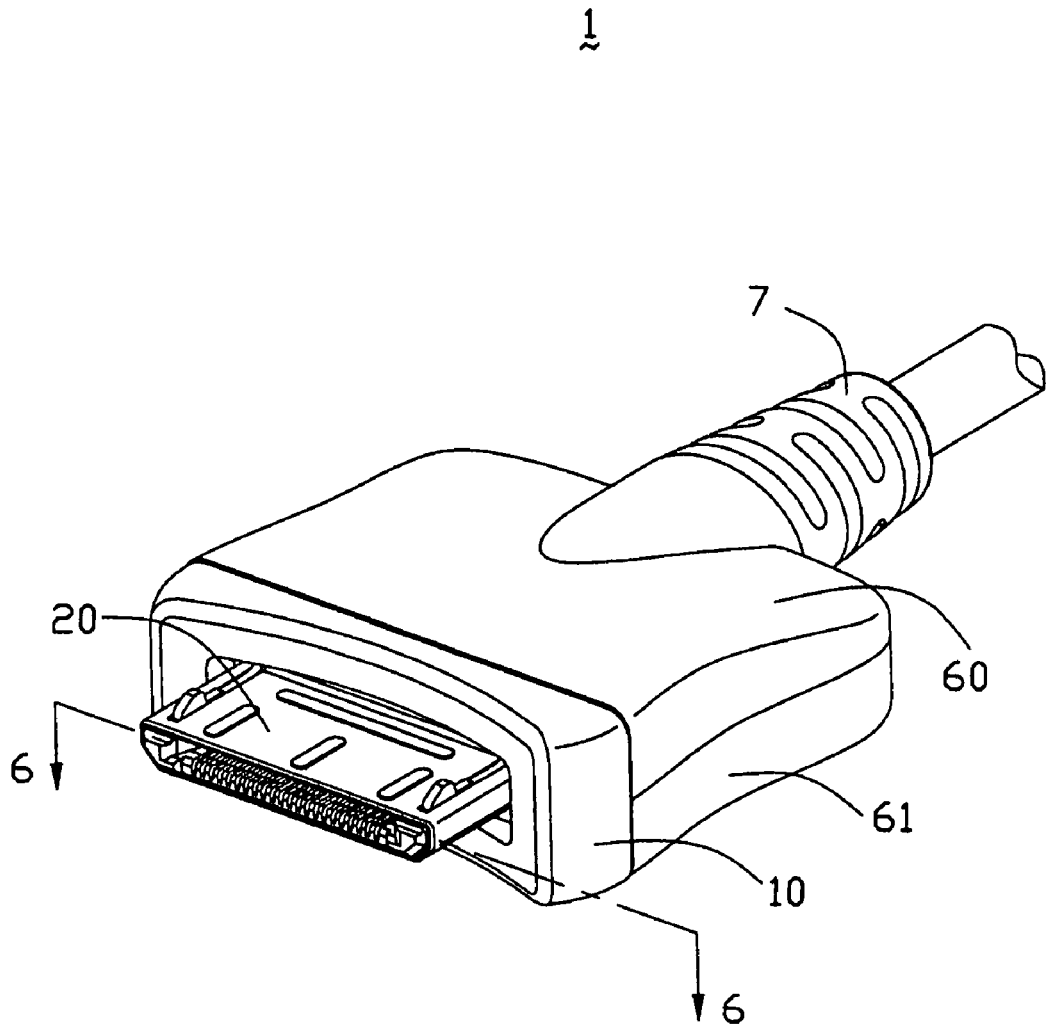
FIG. 1 is a perspective, assembled view of an electrical connector assembly in accordance with the present invention.
Figure 2:
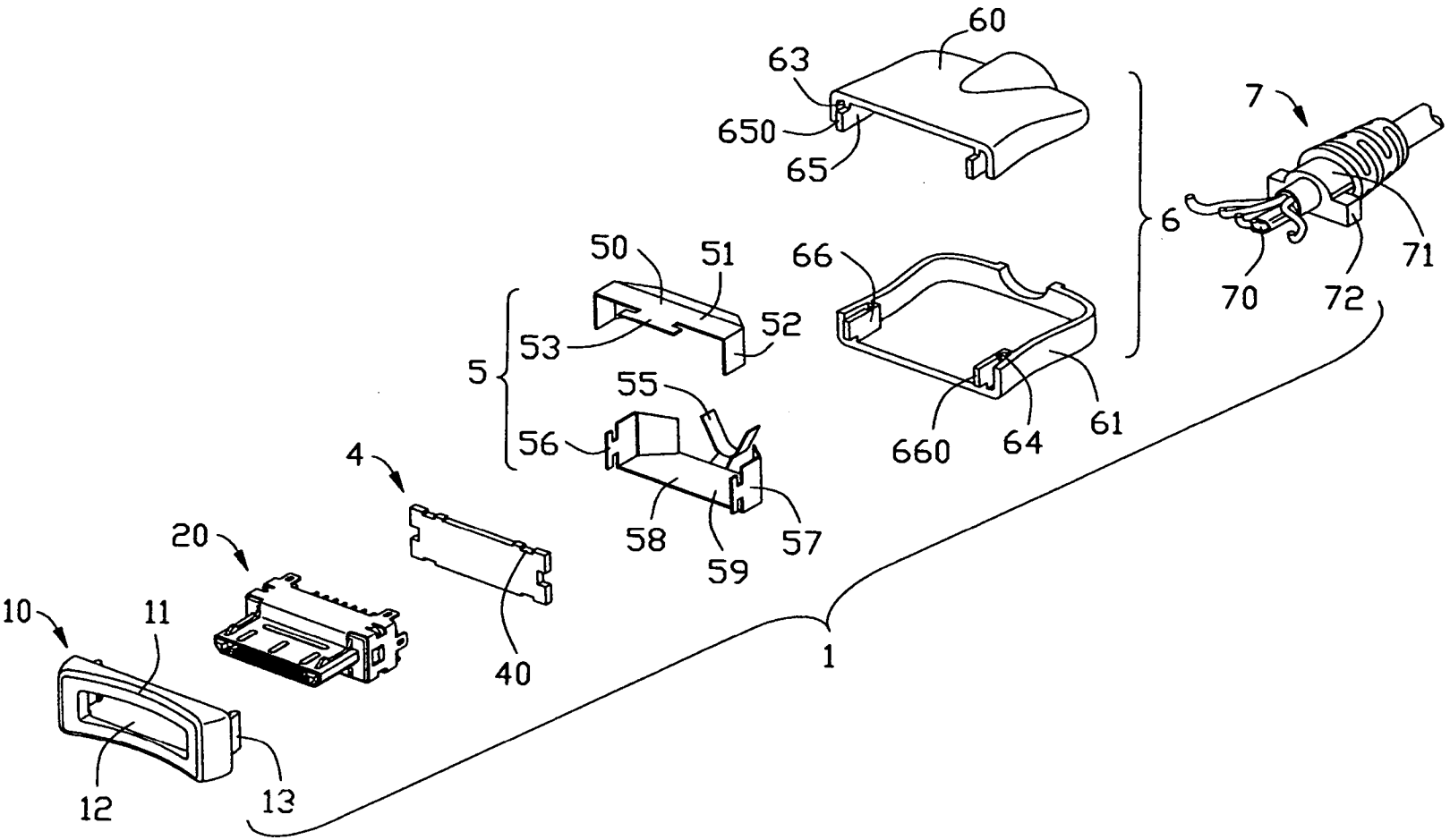
FIG. 2 is a perspective, exploded view of the electrical connector assembly shown in FIG. 1.
Figure 3:
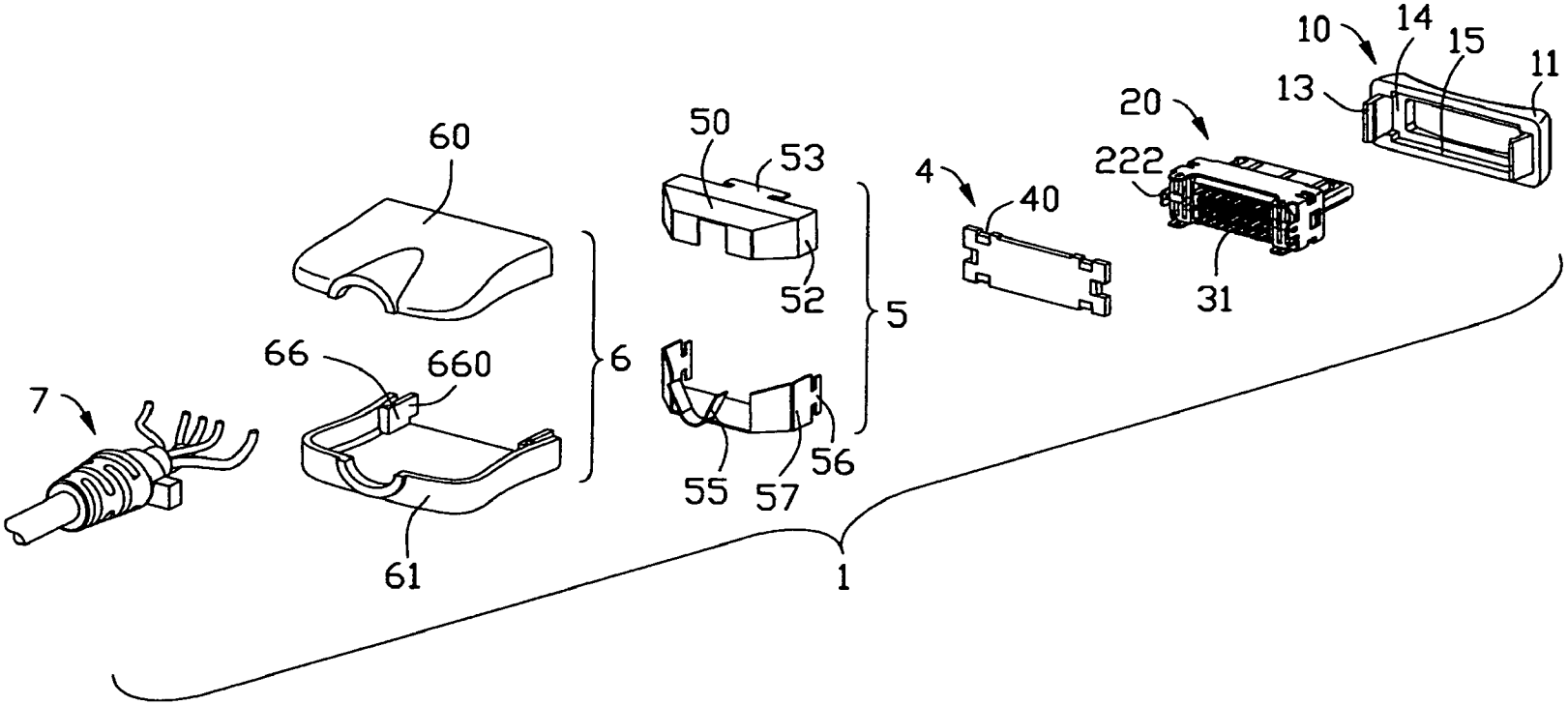
FIG. 3 is a view similar to FIG. 2, but taken from a different aspect.

Referring to FIGS. 1-3, an electrical connector assembly 1 in accordance with the present invention comprises a cover 6, a connector body 20 received in the cover 6, a printed circuit board 4 connected to the connector body 20, a cable 7 soldered to the printed circuit board 4, a shielding shell 5 enclosing a rear portion of the connector body 20 and a front portion of the cable 7, and an insulative cap 10 engaged with the cover 6 from a front side.

Referring to FIG. 1-6, the connector body 20 with a generally T-shape configuration, includes a connector housing 21, a plurality of contacts 3 received in the connector housing 21, and a metal shell 22 enclosing the connector housing 21 for providing a protection against EMI (Electro Magnetic interference). The connector housing 21 includes a generally rectangular main portion 23, and a tongue portion 24 forwardly extending from a front surface of the main portion 23. A plurality of contact passageways (not labeled, shown in FIG. 6) extends through the main portion 23 and the tongue portion 24 so as to receive said contacts 3 therein. Wherein, each contact 3 comprises a mating end 30 retained in the contact passageways, for mating with a corresponding connector, and a tail end 31 opposite to the mating end 30 and extending beyond a rear surface of the main portion 23. The metal shell 22 includes a rectangular frame section 220, and a tongue section 221, for respectively enclosing said main portion 23 and tongue portion 24. In a preferred embodiment, a protruding 230 formed at the main portion 23, and an opening 223 defined in the frame section 220, lock with each other for providing a reliable connection therebetween. Further, the frame section 220 includes a plurality of positing pieces 222 respectively and rearwardly extending from a rear edge thereof and being parallel to tail ends 31 of the contacts 3.

Figure 4:
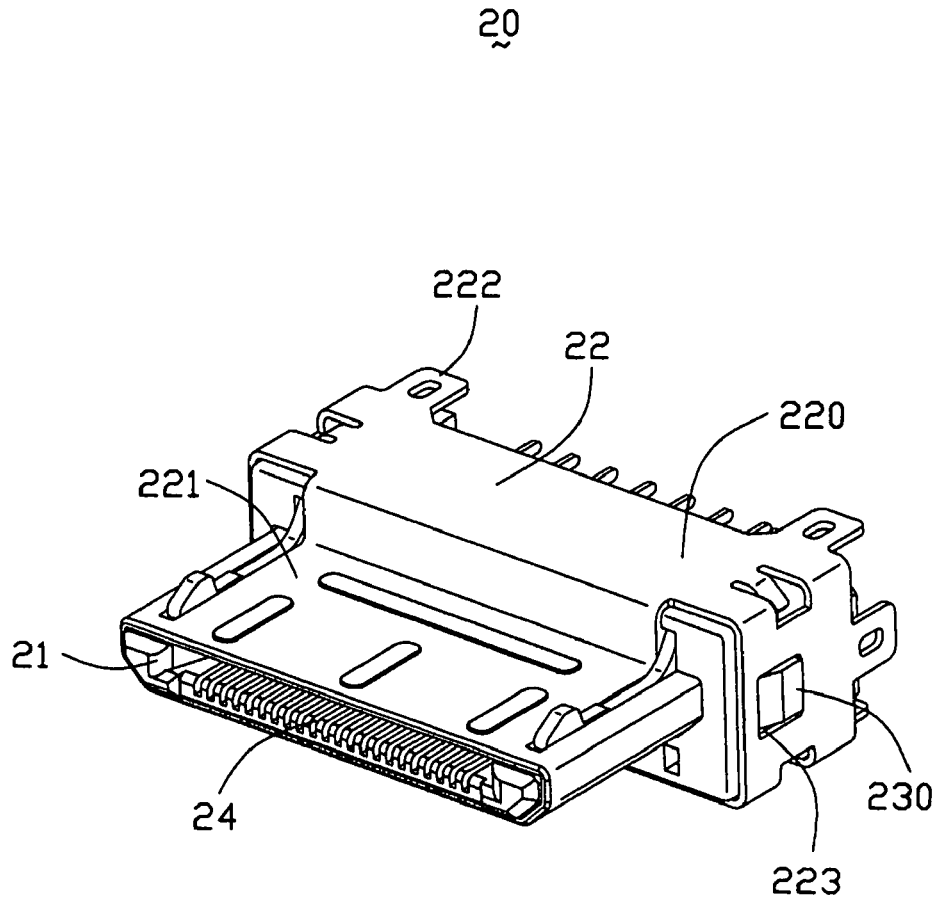
FIG. 4 is a perspective, assembled view of a connector body of the electrical connector assembly.
Figure 5:
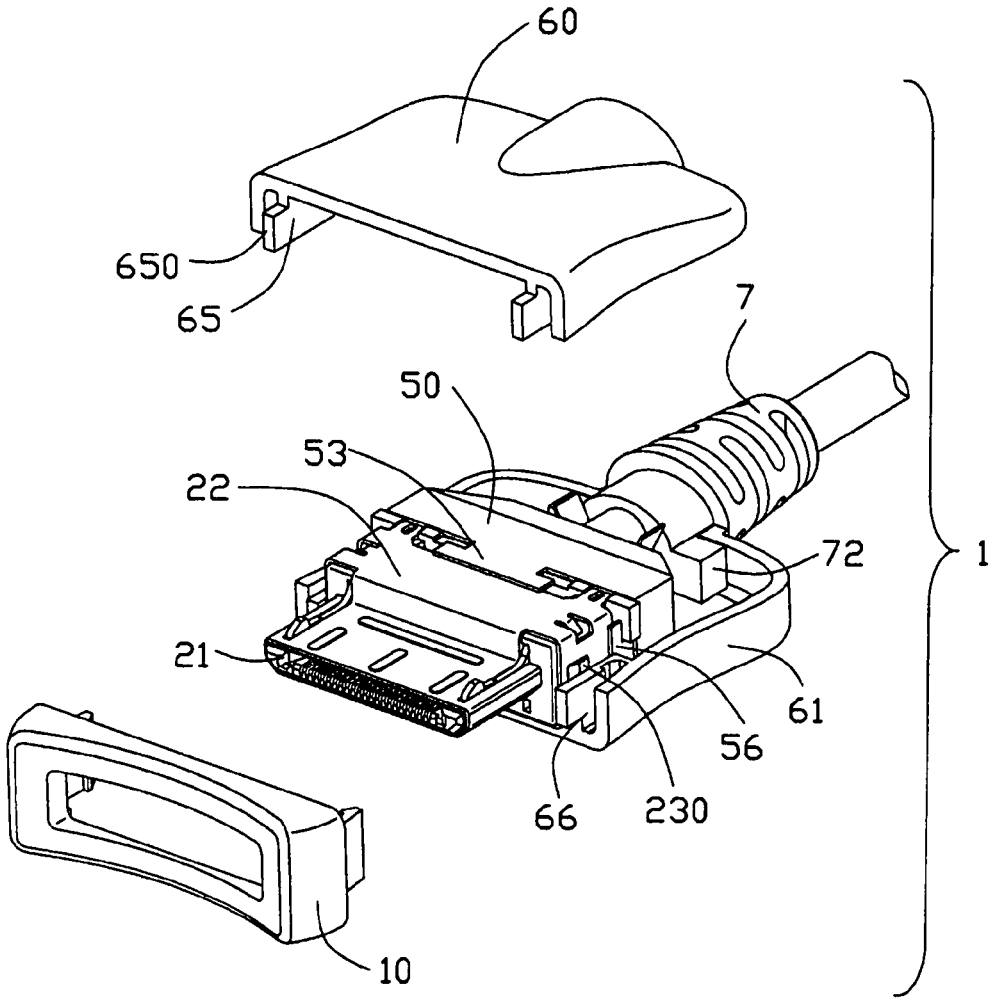
FIG. 5 is a partially, assembled view of the electrical connector assembly shown in FIG. 2.

Referring to FIGS. 3-4, the printed circuit board 4 is of a generally rectangular configuration, and includes a plurality of through holes (not shown) for receiving and soldering with said tail ends 31, and a plurality of apertures 40 disposed at four edges for fittingly holding said positing pieces 222. It is noted that the printed circuit board 4 defines a mating plane, which is perpendicular to a front-to-rear direction, and the tail ends 31 of contacts 3 are inserted into the through holes and facing to said mating plane.

Figure 6:
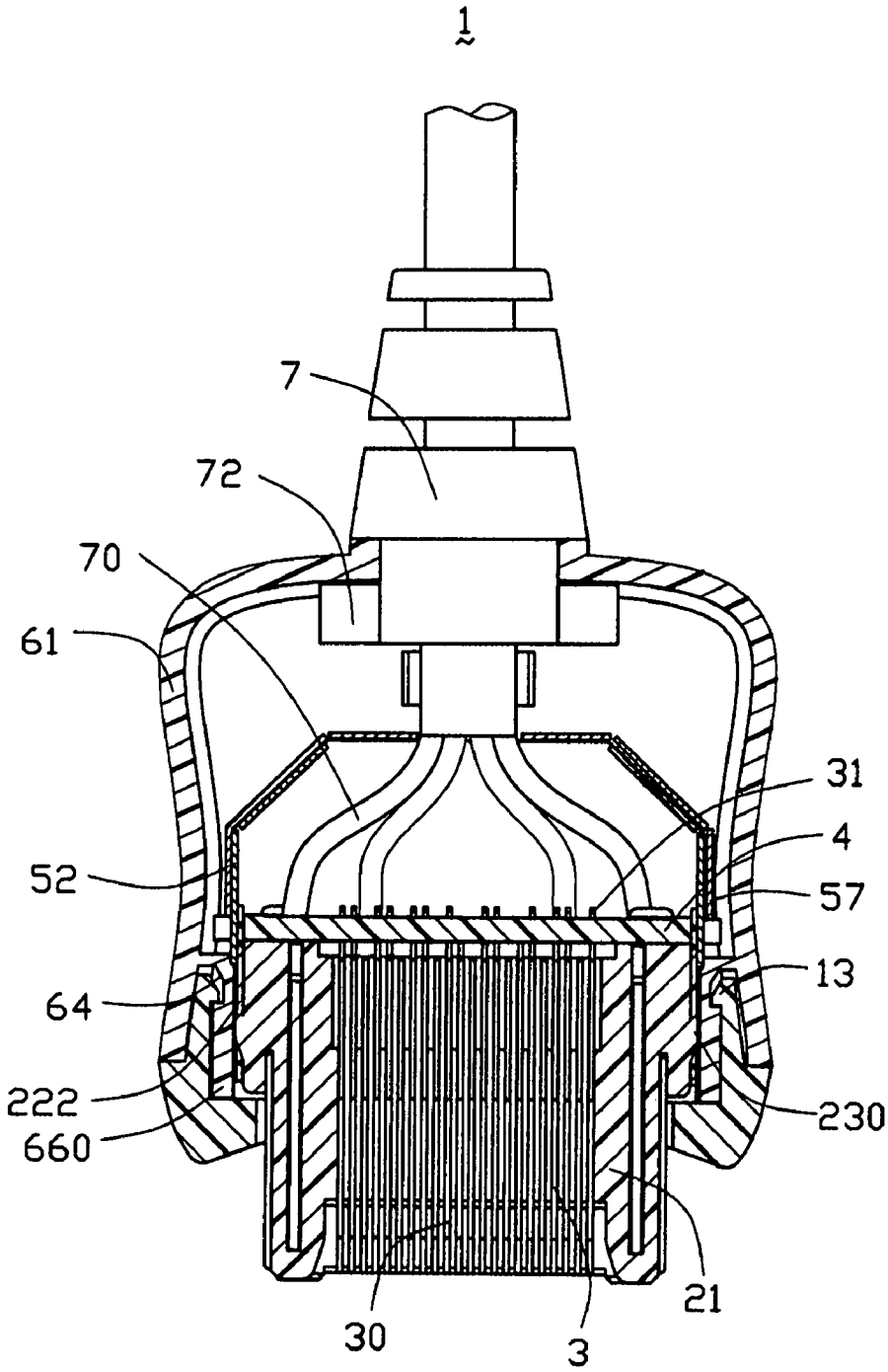
FIG. 6 is a cross-sectional view of the electrical connector assembly of FIG. 1 taken along line 6-6 of FIG. 1.

Referring to FIGS. 2-3, the shielding shell 5 is consisted of an upper shell 50, and a lower shell 59 that are all stamped from a piece of metal or other conductive materials. The upper shell 50 includes an upper wall 51, and a pair of lateral walls 52 downwardly extending from the upper wall 51. The upper wall 51 forms a T-shape piece 53 forwardly extending from a front edge thereof. The lower shell 59 with a similar shape as the upper shell 50, includes a lower wall 58, a pair of lateral walls 57 upwardly extending from the lower wall 58, and a cable clamp 55 rearwardly extending from a rear edge of the lower wall 58 for clamping a grounding layer (not shown) of the cable 7 and providing a grounding performance. In addition, each lateral wall 57 forms a T-shape piece 56. Referring to FIG. 6, the upper and lower shells 50, 59, respectively from top and bottom sides, enclose a rear portion of the connector body 20, and reliably lock with the printed circuit board 4 by an engagement between the T-shape pieces 56 and the apertures 40 formed at two lateral edges of the printed circuit board 4. Noticeably, the two lateral walls 52 of the upper shell 50 are located at inner sides of the lateral walls 57 of the lower shell 59.

Referring to FIG. 2, the cable 7 includes a plurality of conductors 70 for soldering with the tail ends 31 of the contacts 3, and the grounding layer (not shown) surrounding the conductors 70, an insulative jacket (not shown) surrounding the grounding layer for providing protection, and a stress relief 71 integrally molded with the insulative jacket. The stress relief 71 forms a pair of locking block 72 laterally extending therefrom.

Referring to FIGS. 2-3 in conjunction with FIG. 6, the cover 6 comprises an upper cover half 60, and a lower cover half 61 that is similar to the upper cover half 60 in shape. These two cover halves 60, 61 together define a receiving space (not labeled) for receiving said connector body 20, said shielding shell 5, said printed circuit board 40 and a front portion of the cable 7. In a preferred embodiment, these two cover halves 60, 61 are molded together by ultrasonic welding process, after corresponding elements are received in said receiving space. In addition, in another preferred embodiment, the cover 6 is unitarily molded on the corresponding elements, which is named after "one-piece" configuration, and needlessly shaped as "two-piece" as illustrated in FIG. 2. No matter what the cover 6 is of "one-piece", or "two piece" configuration, a pair of reversed L-shape ribs 65, 66 are respectively formed at positions adjacent to front edges of the lateral walls of the cover 6, and thereby defining a pair of retaining slots 63, 64. In two-piece configuration, the retaining slots 63 in said upper cover half 60, associated with the retaining slots 64 in said lower cover half 61, together define a pair of retaining slots similarly as that of one-piece configuration. Each reversed L-shape rib 65, 66 forms a flange 650, 660 that all extends beyond a front edge of the cover 6.

Referring to FIGS. 2-3, the insulative cap 10 is of a rectangular frame shape, and includes a lengthwise base section 11, and a pair of locking barbs 13 rearwardly and perpendicularly extending from two lateral sides of rear edges of the base section 11. The base section 11 defines a generally rectangular opening 12 at middle thereof from a front view, through which the tongue portion 24 extends, a receiving room 15 stepped relative to the rectangular opening 12, and a pair of inserting slot 14 communicated with the receiving room 15 and defined at two lateral sides of receiving room 15. Noticeably, in this preferred embodiment, a mating interface of the insulative cap 10 is of a depressed arc shape for fittingly cooperating with another mating interface of a complementary connector. According to shapes of the complementary connectors, the insulative cap 10 may be chosen with a corresponding shape.

Referring to FIGS. 1-6, in assembly, in one-piece cover 6 manner, after the connector body 20, the printed circuit board 4, the shielding shell 5, and the cable 7 are assembled together, the unitary cover 6 is molded on said elements, with a pair of retaining slots 63, 64 formed adjacent to front edges thereof. In two-piece cover 6 manner, after assembly of said elements, the upper and lower cover halves 60, 61 enclose said elements, and unitarily mold with each other by ultrasonic welding process. Lastly, the insulative cap 10 is assembled to the cover 6 from a front side, until a front of the main portion 23 is received in the receiving room 15, and the pair of flanges 650, 660 are restrictively held in the inserting slots 14 for preventing the insulative cap 10 from shaking upwardly or downwardly, with the tongue portion 24 extending through the opening 12. During this assembly process, the locking barbs 13 are respectively inserted into and locked with the retaining slots 63, 64 for holding the insulative cap 10 reliably with the cover 6. As illustrated in FIG. 6, tips of the locking barbs 13 are respectively retained within a pair of hollows of retaining slots 63, 64 for holding the insulative cap 10 and the cover 6 together.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly, comprising:

a cover including an upper cover half, and a lower cover half that together defining a receiving space;

a connector body received in the receiving space, and comprising a metal shell, a connector housing received in the metal shell and a plurality of contacts received in the connector housing, each contact including a mating end, and a tail end opposite to the mating end;

a cable including a plurality of conductors electrically connected to said tail ends of contacts;

an insulative cap assembled to the cover from a front side, and including a base section, and a pair of locking barbs rearwardly extending from the base section; wherein said upper and lower halves together defines a pair of retaining slots at two lateral sides thereof, and said locking barbs are respectively inserted into and locking with the retaining slots for reliably fastening said insulative cap to said cover.

2. The electrical connector assembly as described in claim 1, wherein each cover half comprises a pair of reversed L-shape ribs formed at front and lateral sides thereof, said ribs, together with two lateral walls of the cover halves, define said retaining slots.

3. The electrical connector assembly as described in claim 1, wherein the connector housing including a main portion, and a tongue portion extending from a front surface of the main portion, said base section of insulative cap includes a central opening located between the locking barbs along a lengthwise direction, through which the tongue portion forwardly extends beyond a mating interface of the insulative cap.

4. The electrical connector assembly as described in claim 1, wherein further comprising a printed circuit board, which is assembled to the connector body, with a mating plane thereof being perpendicular to a front-to-rear direction, and said tail ends of contacts being received in through holes defined in the printed circuit board.

5. The electrical connector assembly as described in claim 4, wherein the metal shell forms a pair of positing pieces rearwardly extending beyond a rear surface of the connector housing, and the printed circuit board includes a pair of apertures at two lateral sides thereof for restrictively engaging with the positing pieces.

6. The electrical connector assembly as described in claim 5, wherein the assembly also includes a metal shell enclosing a rear portion of connector body, with a pair of T-shape pieces extending from two lateral walls thereof, the T-shape pieces restrictively engages with apertures and is overlapped with the positing pieces.

7. The electrical connector assembly as described in claim 1, wherein each cover half comprises a pair of ribs inwardly extending from inner surfaces of lateral walls thereof, and each rib is of a reversed L-shape cross-sectional view.

8. The electrical connector assembly as described in claim 7, wherein each rib includes a flange forwardly extending beyond a front edge of the cover, and the insulative cap comprises a pair of inserting slots for restrictively receiving corresponding flanges.

9. An electrical connector assembly comprising:

a cover, including a pair of ribs formed at inner thereof, and a pair of retaining slots between the ribs and corresponding lateral walls thereof, each retaining slot defining a hollow at a root region thereof;

a connector housing received in the cover, and including a mating port, and a connecting port;

a plurality of contacts, each contact including a mating end received in the mating port, and a tail end rearwardly extending beyond the connecting port;

a cable, electrically terminated to said tail ends of the contacts; and an insulative cap, including a generally rectangular base section with a central opening for allowing said mating port to extend through, and a pair of locking barbs rearwardly from the base section; wherein tips of the locking barbs are respectively retained within said hollows of retaining slots for holding the insulative cap and the cover together.

10. The electrical connector assembly as described in claim 9, wherein the locking barbs are located at two lateral sides of the opening, with said pair of tips being opposite to each other.

11. The electrical connector assembly as described in claim 9, wherein the cover includes an upper cover half, and a lower cover half, these two cover halves are molded with each other by ultrasonic welding.

12. The electrical connector assembly as described in claim 9, wherein further comprising a printed circuit board assembled to the connecting port from a rear side, with a mating plane thereof being perpendicular to a mating direction of the electrical connector assembly.

13. The electrical connector assembly as described in claim 9, wherein each rib includes a positing piece forwardly extending beyond a front edge of the cover, and said insulative cap includes an inserting slot at an inner side of the locking barb for restrictively receiving the positing piece therein.

14. An cable connector assembly comprising:

a connector body including a frame section and a tongue section extending forwardly from the frame section, a mating slot defined in the tongue section, a plurality of contacts disposed in the housing and exposed to the mating slot;

a cover enclosing the frame section; and a cap fastened to the cover and enclosing a rear portion of the tongue section; wherein a circumferential gap is formed between said cap and tongue section for receiving a circumferential shell of a complementary connector which has a mating plate received in said mating slot.

15. The cable connector assembly as claimed in claim 14, wherein a front face of said cap is bowed inwardly around a mid-point of said housing body in a lengthwise direction.

16. The cable connector assembly as claimed in claim 14, wherein a pair of latches exposed upon an exterior face of the tongue section, and a portion of each of said latches protectively enclosed in said cap.

17. The cable connector assembly as claimed in claim 16, wherein a latching hook of each of said latches is exposed outside of the cap.

* * * * *